United States Patent [19]

Toda et al.

[11] 4,087,281

[45] May 2, 1978

[54] METHOD OF PRODUCING OPTICAL IMAGE ON CHROMIUM OR ALUMINUM FILM WITH HIGH-ENERGY LIGHT BEAM

[75] Inventors: Minoru Toda; Susumu Osaka, both of Machida, Japan

[73] Assignee: RCA Corporation, New York, N.Y.

[21] Appl. No.: 614,855

[22] Filed: Sep. 19, 1975

[51] Int. Cl.[2] ..... G03C 5/00

[52] U.S. Cl. ..... 96/36; 96/27 R; 96/27 E; 96/38.3; 156/654; 156/655; 156/664; 156/665; 219/121 LM; 346/76 L; 427/53

[58] Field of Search ..... 96/36, 27 H, 27 R, 27 E, 96/38.3; 156/7, 18, 22, 654, 655, 664, 665; 204/157.1 H; 219/121 LM, 121 L; 427/53; 346/76 L

[56] References Cited

U.S. PATENT DOCUMENTS

| | | | |
|---|---|---|---|
| 3,574,014 | 4/1971 | Hugle | 219/121 LM |
| 3,649,806 | 3/1972 | Konig | 219/121 L |
| 3,682,729 | 8/1972 | Gukelberger et al. | 156/18 |
| 3,707,372 | 12/1972 | Hallman et al. | 96/36 |
| 3,787,873 | 1/1974 | Sato et al. | 219/121 LM |
| 3,816,317 | 6/1974 | MacArthur | 156/18 |
| 3,832,948 | 9/1974 | Barker | 219/121 LM |
| 3,866,398 | 2/1975 | Vernon et al. | 156/17 |
| 3,873,341 | 3/1975 | Janus | 156/7 X |
| 3,898,417 | 8/1975 | Atkinson | 156/18 |
| 3,920,951 | 11/1975 | Chovan et al. | 219/121 L |
| 3,996,057 | 12/1976 | Kawaziri et al. | 96/36 X |
| 3,999,990 | 12/1976 | Janai et al. | 96/36 X |

*Primary Examiner*—Edward C. Kimlin

*Attorney, Agent, or Firm*—H. Christoffersen; Birgit E. Morris

[57] ABSTRACT

A latent image is produced on a metallic film having at least one layer of chromium or aluminum by exposing the film to a light pattern. The intensity of the light from the light pattern must be below the threshold for evaporation of the metallic film. The latent image is developed by dipping the metallic film into an etchant.

13 Claims, No Drawings

METHOD OF PRODUCING OPTICAL IMAGE ON CHROMIUM OR ALUMINUM FILM WITH HIGH-ENERGY LIGHT BEAM

BACKGROUND OF THE INVENTION

The present invention relates to a method of producing optical images on metallic films and more particularly to a method of producing optical images on chromium or aluminum films.

Heretofore methods of producing optical images on metallic films have involved the use of a photoresist. A photoresist is applied on a metallic film; the photoresist is exposed to a light pattern and is then developed. The development process selectively removes portions of the photoresist to expose the underlying metal. The metal can then be etched by dipping it in an appropriate etchant.

Direct one-step photo-etching method, without the use of a photoresist, has also been accomplished. A source of intense light, such as a laser, is used to selectively etch the metallic film directly. The light source must be of such intensity that evaporation of the metallic film is accomplished upon exposure to the light source.

SUMMARY OF THE INVENTION

A latent image is produced on a metallic film having at least one layer of chromium or aluminum by exposing the film to a light pattern, produced by a light source, having an energy intensity level below the threshold for evaporation of the metallic film. The latent image is developed by dipping the metallic film in an etchant.

DETAILED DESCRIPTION OF THE INVENTION

The method of the present invention comprises exposing a metallic film having at least one layer of chromium or aluminum to a light pattern, produced by a light source such as a laser, having an energy intensity level below the threshold for evaporation of the metallic film, to form a latent image. The latent image is developed by dipping the exposed metallic film into an etchant.

There are a number of advantages of the present invention. First, direct etching of a metallic film without the use of a photoresist is achieved. Secondly, if a laser beam is used as the light source, submicron size resolution can be achieved from the interference pattern of the laser beams. Thirdly, compared to direct one-step photo-etching method, the present invention is more economical in that less power is required. The metallic film with the developed image can be used as an exposure mask for usage in microcircuitry, color T. V. shadow mask, etc.

In one embodiment of the method of the present invention, a metallic film comprising chromium or aluminum is deposited on a substrate, such as glass or quartz. The metallic film is relatively thin (less than about 2,000 A—preferably about 200 A), so the substrate is used for support purposes only and in no way is the composition of the substrate crucial to the present invention. A light source, such as a laser, having an energy intensity level below the threshold for evaporation of the metallic film, is used to form a latent image on the metallic film. The latent image is produced by selectively exposing portions of the metallic film to the light source or by irradiating the light from the light source through a pattern onto the metallic film. For a 200 A film of chromium, the energy intensity level of the light source must be above about 0.3 Joule/cm$^2$ and less than about 1.4 Joule/cm$^2$. The minimum energy intensity level, above which a latent image will be formed on this 200 A thick chromium film by the method of the present invention, corresponds approximately to the melting point temperature of chromium. The maximum energy intensity level corresponds approximately to the sublimation temperature of chromium. Above that energy level, an image will be formed immediately on the metallic film by the evaporation of the metal upon exposure to the light source—as is well-known in the art. To develop the latent image, the metallic film of chromium or aluminum is dipped into a chromium etchant, such as a solution of potassium ferricyanide and sodium hydrate. When the metallic film is selectively exposed to the light source and is then dipped into a chromium etchant, the exposed regions of the metallic film will etch more slowly than the unexposed regions. Thus a "negative" image is formed.

In another embodiment of the method of the present invention, a composite metallic film, comprising chromium on a gold backing, is deposited on a substrate, such as glass or quartz. The chromium layer is on the gold backing which is on the substrate. Again the composite metallic film is thin so the substrate is used for support purpose only and in no way is the composition of the substrate crucial to the present invention. The chromium layer is less than about 2,000 A in thickness—preferably about 600 A. The gold backing is preferably about 2,000 A in thickness. A light source, such as a laser, having an energy intensity level below the threshold for the evaporation of the metallic film, is used to form a latent image on the composite metallic film. The light is incident upon the chromium layer. The latent image is produced by selectively exposing portions of the composite metallic film to the light source or by irradiating the light from the light source through a pattern onto the composite metallic film. The latent image is developed by dipping the composite metallic film into a gold etchant, such as a solution of potassium iodate and iodine. When the exposed composite metallic film is dipped into a gold etchant, the exposed region of the composite metallic film is etched away. Thus, a "positive" image is formed.

Although the exact mechanism, by which a "positive" image is formed, is not known, it is believed that when the chromium layer is irradiated with a light pattern, small invisible pin-holes are formed in the exposed region. These pin-holes are the conduits through which the gold etchant penetrates into the gold backing to dissolve the gold and subsequently "lift" the chromium region above it. Thus, the exposed region is etched away.

As previously noted, the method of the present invention eliminates the need for a photoresist; yet it is more economical than the direct one-step photo-etching method.

The invention will be described with reference to the following specific examples which are given for purpose of illustration only and are not to be taken as in any way restricting the invention beyond the scope of the appended claims.

EXAMPLE I

A 200 A chromium film was deposited on ordinary microscope slides by vacuum evaporation. A rotary-mirror Q-switched ruby laser, having a wavelength of 6943 A and pulse width of $2 \times 10^{-8}$ sec, was used as the light source at a power of approximately $10^7$ to $10^8$ watts/cm$^2$. The laser beam was split into two beams using the reflectance and transmittance of glass plates, and an interference pattern was obtained with mirror reflectors ($\sim$0.7 $\mu$m and 0.35 $\mu$m spacings and line widths respectively). When the chromium film was irradiated by this interference pattern for approximately $2 \times 10^{-8}$ sec., i.e. one pulse, and then dipped into a chromium etchant, a solution containing potassium ferricyanide and sodium hydrate, a grating pattern appeared. The grating pattern appeared after a development period of at least about 100 sec. The grating pattern was the negative of the interference pattern.

EXAMPLE II

A 600 A chromium film was deposited on a 2,000 A gold film on a glass substrate. The deposition of both layers was by vacuum deposition. The chromium surface was exposed to the same laser, through a suitable mask, as that for the 200 A chromium film of Example I. Exposure time and development time, similar to that for the 200 A chromium film of Example I, were used. The composite film was dipped in a gold etchant, a solution containing potassium iodate and iodine. The pattern which developed was the positive of the mask used for exposure.

What is claimed is:

1. A method of producing an image on a metallic film comprised of at least one layer, wherein said one layer, having a thickness less than about 2,000 angstroms, is a material selected from the group consisting of chromium and aluminum, wherein said method comprises the steps of:

exposing said one layer to a light pattern, said light pattern having an energy intensity level which at least approximately corresponds to the melting point of said one layer in said metallic film but is below the threshold for evaporation of said metallic film to form a latent image; and contacting said film with an etchant to develop said latent image.

2. The method in accordance with claim 1, wherein said metallic film comprises said one layer; and said etchant is a solution of potassium ferricyanide and sodium hydrate.

3. The method in accordance with claim 2, wherein said one layer is chromium and is about 200 A in thickness, and said light pattern has an energy intensity level above about 0.3 Joule/cm$^2$ and below about 1.4 Joule/cm$^2$.

4. The method in accordance with claim 1, wherein said metallic film comprises said one layer on a second layer of gold.

5. The method in accordance with claim 4, wherein said etchant is a solution of potassium iodate and iodine.

6. The method in accordance with claim 5, wherein said one layer is chromium; and said one layer is about 600 A in thickness.

7. The method in accordance with claim 6, wherein said second layer of gold is about 2,000 A in thickness.

8. The method in accordance with claim 1, wherein said metallic film comprises a single layer of chromium or aluminum; and said etchant is an etchant for said metallic film; whereby a negative image is formed on said single layer metallic film.

9. The method in accordance with claim 1, wherein said metallic film is a composite which comprises an exposed layer of chromium or aluminum on a gold base; and said etchant is an etchant for said exposed metallic film; whereby a negative image is formed on said composite metallic film.

10. The method in accordance with claim 1, wherein said metallic film comprises said one layer on a second layer of gold; and said etchant is an etchant for gold; whereby a positive image is formed on said composite metallic film.

11. The method in accordance with claim 1, wherein said light pattern is produced by a laser light source.

12. The method in accordance with claim 3, wherein said light pattern is produced by a laser light source.

13. The method in accordance with claim 6, wherein said light pattern is produced by a laser light source.

* * * * *